United States Patent [19]

Ayres

[11] 4,225,063

[45] * Sep. 30, 1980

[54] FLUID DISPENSING PUMP ASSEMBLY

[76] Inventor: John E. Ayres, 540 Fairview Ave., Westwood, N.J.

[ * ] Notice: The portion of the term of this patent subsequent to Apr. 18, 1995, has been disclaimed.

[21] Appl. No.: 805,320

[22] Filed: Jun. 10, 1977

[51] Int. Cl.[2] ..... E05F 9/043; F04B 21/02

[52] U.S. Cl. ..... 222/380

[58] Field of Search ..... 222/380, 383, 498, 499; 137/512.2, 512.4; 417/558, 569, 560, 566, 457

[56] References Cited

U.S. PATENT DOCUMENTS

| | | | |
|---|---|---|---|
| 947,536 | 1/1910 | Wenkel | 137/512.2 X |
| 1,709,948 | 4/1929 | Proctor | 222/49 X |
| 1,911,474 | 5/1933 | Smith | 417/558 |
| 3,337,096 | 8/1967 | Brown | 222/380 |
| 3,794,222 | 2/1974 | Loewenthal | 222/321 X |
| 3,967,644 | 7/1976 | St. Laurent | 137/512.2 X |
| 3,968,905 | 7/1976 | Pelton | 222/498 X |
| 4,057,176 | 11/1977 | Horvath | 222/321 X |
| 4,079,865 | 3/1978 | Kutik | 222/321 |
| 4,084,731 | 4/1978 | Ayres | 417/566 X |

*Primary Examiner*—Robert J. Spar

*Assistant Examiner*—Frederick R. Handren

*Attorney, Agent, or Firm*—Paul J. Sutton

[57] ABSTRACT

An atomizing pump assembly for use with a variety of types of containers is disclosed in which a housing is formed with both an outlet port and an internal fluid chamber that communicates via a passageway with the outlet port. Tubular means provides communication between the fluid chamber in the housing and a reservoir of the material that is to be dispensed by the pump. A flexible frustroconical skirt or diaphragm having a valved opening therethrough is operatively located intermediate the tubular means and both the fluid chamber and the outlet port, with an integral upper portion of the diaphragm initially obstructing the outlet port. When an actuating cap is depressed, material within the fluid chamber is compressed until a minimum predetermined chamber pressure is achieved, whereby under pressure the skirt or diaphragm is flexed from its normal position to a discharge position. The flexing action results in movement of the diaphragm upper portion from its initial obstructing position to a non-obstructing position, whereby fluid contents may be discharged under pressure through the outlet port. Venting means are also provided.

5 Claims, 4 Drawing Figures

FLUID DISPENSING PUMP ASSEMBLY

The present invention relates generally to the art of non-aerosol types of pumps and more particularly to an improved atomizing pump that may be readily attached to one or more types of containers for manually dispensing the contents thereof.

The increasing furor these days about aerosols and the effects of their fluorocarbon propellants upon both the environment and health, whether based upon scientific evidence or not, has caused a great deal of attention to be focused upon alternative methods of dispensing fluids from containers. The "ascent of civilized man" has seen Freon first hailed as a sonder-medium, and more recently attacked as a substance whose release into the atmosphere in significant quantities may alter our atmospheric shield against potemtially harmful radiation from the sun's ultraviolet rays. Others point to volcanic eruptions as an alternate culprit. Of course, few, if any, of the scientists and prophets who advance either argument and who attempt to measure changes in the Earth's upper atmosphere have come up with contributions to advance this art so that the apparent psychological void caused by attacks upon aerosols in the developed countries will be filled.

Lest these comments be misconstrued, the author is most concerned about the well-being of all users and consumers of container-dispensed materials and, therefore, it is with this in mind that the present invention may well be described as a major and significant step forward in the direction of safety and convenience. Furthermore, the relative simplicity of construction and reliability of performance achievable with the subject pump affords the consumer reduced costs associated with fabrication advantages.

The pump and valve arts are crowded with examples of attempts to dispense fluids of different types and viscosities with relative ease and at a minimum of expense. However, in addition to meeting these problems, this invention is specifically directed to yet another problem known to makers and users of atomizing pumps, namely the phenomenon known as "jetting" or "spitting". When fluid is improperly atomized, relatively large fluid particles or aggregates in finite mass or stream forms are ejected from the nozzle with the undesirable result that atomized or fine spray particle dispersion is not realized.

Examples of prior art pump patents known to me include my prior U.S. Pat. No. 3,489,322 which was granted on Jan. 13, 1970. In this patent there is disclosed a fluid dispenser pump of the reciprocating type which is manually operable by means of a vertically reciprocable push button. The pump comprises a housing that is adapted to be seated on a container and the housing of the pump includes an inlet that communicates with the interior of the container. The pump housing also includes a pump cylinder on which the push button is mounted for vertical reciprocation relative thereto and incorporates a valve-controlled discharge chamber which communicates, at one end, with the pump cylinder and at the other end with the housing inlet. A valve member made of a resilient material is slidably mounted in the discharge chamber and frictionally engages a valve-actuating rod that is connected to the push button for movement of the valve member between a discharge position and an intake position in the valve chamber. The pump housing also has one or more vent passages formed therein which communicate with the interior of the container to which the pump is attached. The passageways vent the container to atmospheric pressure during operation of the pump and have outlet openings which are closed by rotation of the push button relative to the pump cylinder to a position where the push button is secured against vertical movement relative to the cylinder.

While the concept disclosed in my aforementioned issued U.S. patent does represent an important contribution to the art, this patent is directed to a pump design that deals with the discharge of liquids, such as hand lotions and the like.

Another example of prior patent art that is of interest, though not anticipatory of the present invention, is U.S. Pat. No. 3,399,836 to Pechstein, in which an atomizing pump is disclosed. The type of pump disclosed by Pechstein has a number of drawbacks, among which is the need for a helical or metallic type of spring in the pump chamber in order to operate. This is not so with my invention. Springs are unreliable in that their spring rates will vary, they require room to expand and contract, and manufacturing tolerances result in an unreliable product.

Other examples of non-anticipatory prior patent art known to me include U.S. Pat. No. 3,647,121 to Ayres; U.S. Pat. No. 3,379,381 to Decaux; U.S. Pat. No. 3,185,355 to Lipman; U.S. Pat. No. 3,102,489 to D. F. Corsette et al.; U.S. Pat. No. 1,308,258 to Rose; U.S. Pat. No. 2,824,673 to Hanlon; U.S. Pat. No. 3,337,096 to Brown; and U.S. Pat. No. 3,497,108 to Mason.

An object of the present invention is to provide an improved atomizing pump, as described below, including improved valve means for controlling the flow of fluid from the interior of its associated container through and out of an outlet or discharge port.

Another object of the present invention is to provide an improved pump design and valving assembly therein which is capable of discharging fluid from a container in an atomized form in which there is virtually no "spitting" or "jetting" of the fluid.

Still another object of the present invention is to provide a pump assembly for use with any one of a variety of types of containers, wherein a minimum predetermined fluid pressure is achieved during normal operation of the pump before the fluid is discharged, thereby assuring more reliable and efficient atomizing or particle dispersion of the fluid being discharged or dispensed.

Still another object of the present invention is to provide a pump assembly having relatively few parts and which may be molded from suitable plastic materials that can be assembled at relatively low cost. In this connection, cost is of particular importance with respect to a pump design of this type since it is contemplated that the user may throw away the entire container and pump assembly once the contents of the container are exhausted. Thus, the pump assembly must be inexpensive.

Yet another object of this invention is to provide a pump assembly capable of achieving the aforemention objects, wherein means are provided for venting the interior of the container with which this pump is associated.

These and other objects and advantages of the present invention will be better and more clearly understood from the following description and the accompanying drawings. The present invention fulfills each of the above objects and overcomes the limitations and disadvantages of prior art attempts to solve the problems by providing, according to one aspect of the invention, a novel assembly made up of a combination of components which cooperate with one another to discharge or dispense the contents of a container in a novel manner.

According to one broad aspect of the present invention, a pump assembly housing capable of cooperating with upper portions of a fluid container includes a dispensing outlet port. This housing further includes a fluid chamber located therein which communicates with the outlet port. A conduit or tube located in operative communication with the fluid chamber is situated so as to be capable of conducting fluid from a reservoir within the container to the fluid chamber. A flexible skirt or diaphragm is located intermediate the reservoir and the fluid chamber, and includes an opening which comprises a portion of the fluid path between the conduit or tube and said fluid chamber. Portions of the skirt or diaphragm define a valve seat with which a ball or other suitable element cooperates in order to provide substantially one-way fluid flow through the diaphragm opening. Another valving arrangement is provided wherein an upper portion of the diaphragm serves as a valving element for controlling the flow of fluid through the dispensing outlet port. This valving element initially obstructs the outlet port and is movable between the obstructing and a non-obstructing position. Actuating means are provided for compressing the contents of the fluid chamber such that the diaphragm, in response to the fluid chamber pressure, moves in a predetermined manner only upon the fluid chamber pressure reaching a predetermined magnitude, whereby the dispensing outlet port is opened and the fluid is dispensed.

The foregoing will be more clearly understood from the detailed description of the accompanying drawings, in which.

Figure 1:
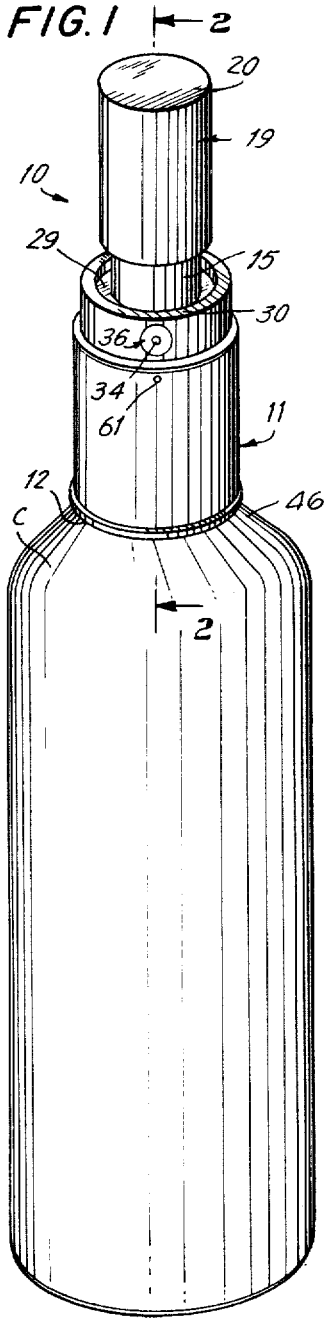
FIG. 1 is a perspective view illustrating the pump assembly according to the present invention, together with its associated container.

Referring now in more detail to the drawings, in FIG. 1 an atomizing pump assembly 10 is shown depicted in a perspective-type view atop and in cooperative assembly with a container designated by reference character C. It should be emphasized here at the outset that the nature of the container with which pump assembly 10 is cooperatively utilized may vary in shape, size, structural configuration and in fluid-holding capacity. One of the principal advantages of the present invention is the cooperative abilities of pump assembly 10 to be utilized with one or more of any number of different types of containers from which fluid will be dispensed.

Figure 2:
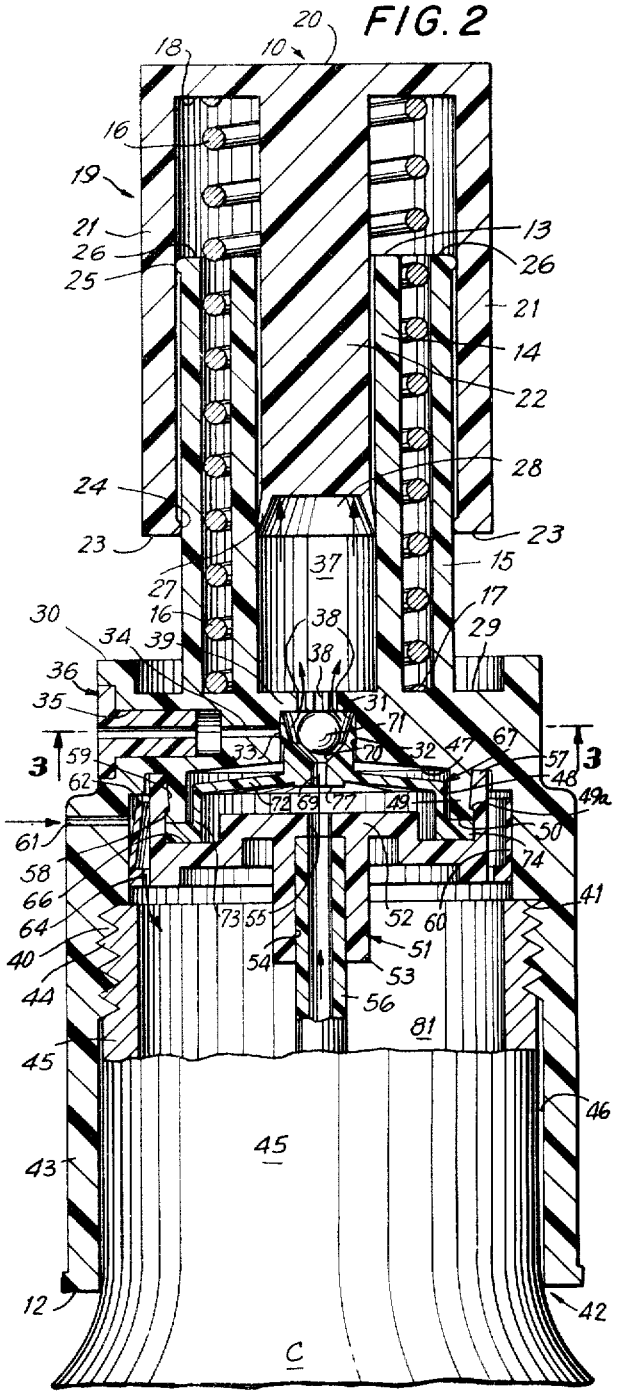
FIG. 2 is a fragmentary sectional elevational view, enlarged somewhat, taken along line 2—2 of FIG. 1, and illustrating the pump according to the present invention during the last extreme of a suction stroke immediately after the fluid has been dispensed.
Figure 3:
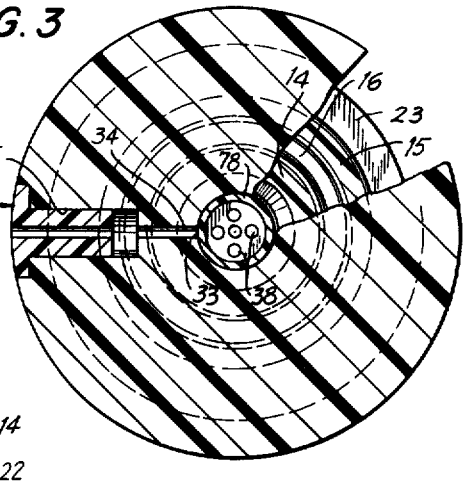
FIG. 3 is a transverse sectional plan view looking in an upward direction along line 3—3 of FIG. 2.

Pump assembly 10 includes a housing assembly 11 which extends from a lower end 12 thereof to an upper end 13. A pair of substantially concentric annular walls 14 and 15 are integrally formed as part of one member of housing assembly 11, such as by injection molding techniques. The annular space between walls 14 and 15 accepts and accommodates a helical spring 16 which is capable of functioning as a compression spring, as will be more clearly apparent after reading the following description. FIG. 2 illustrates spring 16 in its relatively unstressed condition extending from an internal ledge 17 which extends annularly between the lower extremities of the internal surfaces of outer wall 15 and the external surfaces of wall 14. Spring 16 extends from ledge 17 upwardly to and into contact with an internal ledge 18 of a button 19. Button 19 is utilized by the user of pump assembly 10 by applying finger pressure to the upper surfaces 20 of button 19.

Before describing housing assembly 11 in a bit more detail, the reader's attention is directed to button 19 which includes an outer depending outer wall 21 which is spaced from an internal post or plunger 22 located substantially centrally within the space defined by wall 21. It should be noted that the width of the annular space between wall 21 and internal depending post 22 corresponds to the width of annular ledge 18.

Outer wall 21 of button 19 is formed at a lower extremity 23 with an internal rim 24 which extends annularly about the inner surfaces adjacent lower extremity 23. Wall 15 of housing assembly 11 is formed with an outer annular rim 25 adjacent the upper extremity 26 thereof. In use, the cooperative interference between rims 24 and 25 keeps button 19 mounted on and about the upper end and, more specifically, wall 15 of housing assembly 11. It can also be seen from FIGS. 1 and 4 of the drawings that wall 15 obscures spring 16 from view such that a more pleasing overall appearance of pump assembly 10 is realized.

The central and internal depending post 22 of button 19 is formed with a slightly flared depending and feathered wall 27 at its lower extremity, which defines a recess 28 therewithin. When assembled, flared and feathered wall 27 is in contact with the internal surfaces of wall 14 of housing assembly 11, thereby providing a piston-like cooperation assembly therebetween. The pressure of flared wall 27 against the internal surfaces of wall 14 is sufficient to provide a substantially fluid-tight seal therebetween.

Upon depression of button 19 by the user's finger upon upper surfaces 20, the button will ride downwardly against the upwardly directed compressive forces of helical spring 16 until it reaches its limit defined by engagement between lower extremity 23 of button 19 and an upwardly facing ledge 29 defining the base of an annular groove formed within shoulder surfaces 30 of housing assembly 11 about the perimeter of upstanding wall 15. The compressive forces created within spring 16 as a result of the depression of button 19 will cause button 19 to be returned to its normal position shown in FIG. 2 once the user releases his or her finger from the button.

Figure 4:
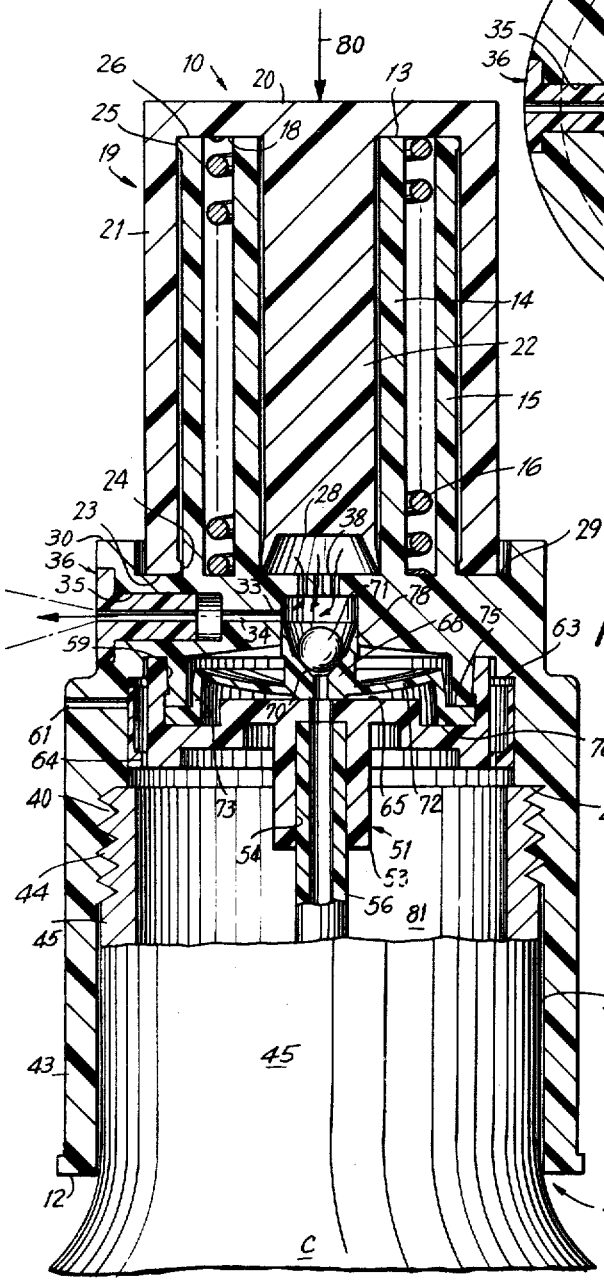
FIG. 4 is a fragmentary sectional elevational view similar to FIG. 2, in which the pump according to the present invention is shown during a compression stroke, wherein fluid is being dispensed.

Referring now once again to housing assembly 11, it can be seen in FIGS. 2 and 4 that the housing assembly is formed with an internal fluid chamber 31 which is at least partially defined by internal walls 32 which, in turn, are formed with an outlet dispensing port 33 therein. Outlet port 33 communicates with an outlet or dispensing opening 34 which, in turn, communicates with an enlarged opening 35 within which an atomizing nozzle assembly 36 is situated. In a preferred embodiment of this invention, atomizing nozzle assembly 36 is simply inserted into opening 35 during assembly of pump assembly 10 and is frictionally held in place thereafter.

Internal fluid chamber 31 communicates with a fluid chamber 37 at least partially defined by recess 28 and the confines of the space within wall 14 and below internal depending post 22. Fluid chambers 31 and 37 communicate with one another by means of openings 38 which extend through a horizontal web portion 39 of housing assembly 11. Openings 38 are large enough to accommodate the flow of fluid therethrough under operative conditions that will be described in more detail below.

I wish to emphasize at this point in the specification that my use of the word "assembly" in describing the housing and other "sub-assemblies" does not necessarily denote assemblages of a plurality of parts. As already stated, it is a purpose of the present invention to provide a relatively inexpensive pump assembly that may be discarded by the user after the contents of the fluid container are exhausted. Therefore, it must be emphasized here that each reference to an "assembly" within this specification contemplates the assembly comprising a single integral injection-molded or otherwise molded assembly of cooperative portions thereof.

Housing assembly 11 is further formed with female or internal threads 40 which extend from an internal shoulder 41 of the housing to a relatively smooth-surfaced receiving opening 42 defined by a relatively depending substantially cylindrical wall 43. Threads 40 are of a predetermined and preselected configuration adapted to matingly and cooperatively engage the external threads 44 of an upper neck portion 45 of container C. The internal diameter of wall 43 is such that a clearance space 46 is provided between wall 43 and the neck 45 of container C, thereby providing relatively easy insertion of the container neck into housing assembly 11 of pump assembly 10. In the embodiment of the present invention shown in FIG. 4, as an example, the inner annular edges of lower end 12 come into contact with the neck of the container C such that an engaging line of support yet further stabilizes the entire pump assembly upon the container.

Housing assembly 11 is yet further formed with an internal configuration which lends itself to the insertion of component parts of the present invention. More specifically, the internal walls 32 which have previously been described as defining fluid chamber 31 meet converging or frustro-conical surfaces 47 which, in turn, extend between walls 32 and a substantially vertical and cylindrical surface represented by reference character 48. Surface 48 defines the inner boundary of a depending retaining lip 49 formed with said surface 48 at its internal extremities and extending downwardly to its lowermost extremity to bearing surfaces 50. Thus, surface 48 extends downwardly from frustro-conical surfaces 47 to the edge where surface 48 joins bearing surfaces 50.

The cross-sectional shape of retaining lip 49 is somewhat L-shaped such that a retaining ledge 51 extends substantially horizontally and annularly about lip 49.

Housing 11 accommodates and captively receives and holds a retainer or retainer assembly 51. Retainer 51 includes a substantially central portion 52 having an integral depending hollow cylindrical tube support 53. A tube opening 54 is defined by tube support 53. Central portion 52 is further formed with an inlet port 55 which communicates with tube opening 54. As shown in FIGS. 2 and 4, tube support 53 and its tube opening 54 captively receive and hold a dip tube 56 which extends from inlet port 55 down into container C to a point at its opposite end which is located well below the level of the reservoir of fluid normally held by container C. The engagement between the outer walls of dip tube 56 and the surfaces of tube support 53 which define tube opening 54 and frictionally engage the dip tube is such that a substantially fluid-tight seal is achieved.

Retainer 51 extends outwardly from its central portion 52 to an upstanding annular retaining wall 57. Retaining wall 57 is formed with a retaining lip 58 which, upon insertion of retainer 51 into the position within housing 11 shown in FIG. 4, cooperatively engages and is held by the ledge of retaining lip 49*a*. The inclined surfaces 59 of retaining wall 57 provide for relative ease of insertion of retainer 51 into housing 11, serving to cause both an outward yielding of retaining wall 57 and an inward yielding of retaining lip 49 during assembly of retainer 51 into the housing.

Retainer 51 is further formed with an outer annular and substantially cylindrical vent sealing wall 60 which is spaced from upstanding retaining wall 57 and which is relatively thin and flexible. In the assembled position shown in FIG. 4, for example, vent sealing wall 60 overlies the opening to a vent port 61 which extends through wall 53. The restoration forces within vent sealing wall 60 normally cause it to cover vent port 61, except under the predetermined conditions that will be described below.

The height of vent sealing wall 60 is such that its uppermost surfaces 62 do not come into engagement with internal housing surfaces, thereby leaving a vent space 63 therebetween. Furthermore, the material joining vent sealing wall 60 and retaining wall 57 is formed with a plurality of slots 64 which communicate both with vent space 63 and the confines of container C about dip tube 56 and above the level of the reservoir fluid within the container.

A central ledge 65 atop retainer central portion 52 is stepped relatively higher than an annular ledge 66 which encircles the central ledge.

Another component element of the embodiment of the pump assembly 10 shown in FIGS. 1–4 is a diaphragm assembly 67. Diaphragm assembly 67 is formed with a central hub 68 through which a fluid opening 69 is formed. Upper frustro-conical surfaces 70 of hub 68 comprise a valve seat against which a spherical ball 71 is adapted to come to bear, thereby cooperatively serving as a ball check valve for substantially one-way fluid flow upwardly through fluid opening 69 of diaphragm assembly 67, when assembled.

A substantially frustro-conical and relatively thin-walled skirt portion 72 extends outwardly from and integrally with central hub 68 to a substantially cylindrical vertical wall 73. In turn, wall 73 extends downwardly from skirt portion 72 to an outwardly directed flange 74 having upper surfaces 75 and lower surfaces 76.

Central hub 68 extends from a lowermost bearing surface 77 immediately surrounding fluid opening 69 upwardly to an outwardly flared and tapered valve wall 78. The outer edges of tapered or feathered valve wall 78 engage internal wall surfaces 32 to provide a substantially fluid-tight seal therebetween. In the normal rest position shown in FIG. 2, valve wall 78 covers and seals outlet port 33. Valve wall 78 is capable of moving along the internal surfaces of internal wall 32 as will become more apparent.

When assembled, diaphragm assembly 67 is captively held between retainer assembly 51 and internal portions of housing 11. More specifically, flange 74 is sandwiched between bearings surfaces 50 of retaining lip 49 which engage upper surfaces 75 and annular ledge 66 of retainer assembly 51 which bear against lower surfaces 76 of the flange 74. This sandwiching is effected to provide a fluid-tight seal between these bearing surfaces and transverse movement is prevented by means of the snug fit of the central hub 68 and its valve wall 78 within and against the wall surfaces defining fluid chamber 31.

Skirt portion 72 of diaphragm 67 is flexible or movable between extreme positions, with the flexing of this skirt portion of diaphragm 67 taking place with a relatively abrupt or snap-like action. Given a predetermined minimum force downwardly upon the upper surfaces of central hub 68 of diaphragm assembly 67, the skirt portion 72 will abruptly flex with an abrupt snap-like action, moving downwardly to a position shown in FIG. 4 and limited in this downward movement by contact between bearing surfaces 77 and central ledge 65 of retainer assembly 51. This abrupt or snap-like action results in a corresponding movement of the integral feathered valve wall 78 downwardly along internal walls 32 to a point where outlet port 33 is no longer covered by valve wall 78 and this outlet port is in communication with internal fluid chambers 31 and 37. Upon removal of downward forces or pressure upon central hub 68 of diaphragm assembly 67 to a magnitude below said predetermined level, memory characteristics of diaphragm assembly 67 and its skirt portion 72 will result in a reverse abrupt snap-like action whereby frustro-conical skirt portion 72 automatically returns to normal position, thereby returning the valve wall 78 to its initial sealing position overlying outlet port 33.

In operation or use, the user depresses button 19 by pressure of his or her forefinger upon upper surfaces 20 of the button in the direction of the arrow 80 of FIG. 4. The button is caused to be moved downwardly under this pressure of the forefinger against the compressive upwardly biasing forces of helical spring 16, as well as against the resisting forces of fluid being compressed within fluid chambers 31 and 32. This fluid pressure just mentioned is created as a result of the fluid-tight seal of ball 71 against its seating surfaces 70, as well as the covering or sealing of outlet port 33 by means of the presence of valve wall 78 thereover. Upon a sufficient and predetermined minimum pressure with fluid chambers 31 and 37 acting upon central hub 68 of diaphragm assembly 67, a minimum downward force transmitted to the skirt portion 72 will be achieved, whereby skirt portion 72 will abruptly flex in a snap-like action from a position shown in FIG. 2 to that shown in FIG. 4. With the diaphragm assembly now in the position shown in FIG. 4, fluid disposed within fluid chambers 31 and 37, communicating through openings 38, enters outlet port 33 under pressure such that it passes through dispensing opening 34 and through the atomizing nozzle assembly 36 located within enlarged opening 35, and thereafter to the atmosphere. The combination of said minimum fluid pressure and the presence of a suitable atomizing nozzle assembly 36 provides for a proper breaking-up of the dispensed fluid into small droplets. The predetermined pressure is achieved as a result of the piston-like action of post 22 and its flared wall 27 coacting with and against housing wall 14 during the downward button stroke.

Once the dispensing stroke is completed, the user simply releases pressure upon button 19 such that it returns as a result of the upwardly compressing restoring forces of helical spring 16 to its initial position when it is ready to once again and repeatedly be depressed. During this upward return stroke of button 19 and its piston or post 22, a negative pressure within fluid chamber 37 is induced, as compared to atmospheric pressure surrounding the container and the pump assembly 10. This relative negative pressure differential results in ambient air entering vent port 61 about vent sealing wall 60, which has been inwardly flexed as a result of this pressure differential, through vent space 63 to and thereafter through slots 64 until this air finally reaches the confined chamber above the fluid reservoir within container C (for purposes of convenience of the reader referred to as chamber 81). Fluid comprising part of the fluid reservoir within container C is forced upwardly through dip tube 56 as a result of this pressure differential and thereafter passes through inlet port 55 of retainer assembly 51 to and through fluid opening 69 whereupon this fluid thereafter displaces spherical ball 71 from its seat 70 and bypasses the ball to come to rest within fluid chamber 31. This fluid flow from the reservoir along the path just described will substantially cease once the pressure within fluid chambers 31 and 37 has equalized with respect to atmospheric pressure, with the result that the ball 71 will once again come to rest against its seat due to gravity. Of course, fluid within chamber 31 is free to enter chamber 31 via openings 38, and vice versa. Once the pressure differential induced as a result of the upward stroke of piston or post 22 is equalized, the normal outwardly directed inherent flexing forces within vent sealing wall 60 will cause the vent port 61 to once again be covered such that leakage will not occur. Fluid that has entered fluid chamber 31 from the fluid reservoir within container C will not be able to leak through outlet port 33 because of the presence of valve wall 78 covering the outlet port.

The present invention has been described in sufficient detail to enable one of ordinary skill in the art to make and use same. Obvious changes, improvements and alterations of the aforedescribed preferred embodiments of my invention may be made by a reading and understanding of the foregoing specification and drawings, and it is my intention that all such modifications and alterations be included as part of my invention insofar as they come within the proper scope and spirit of the invention defined by the appended claims.

What is claimed is:

1. A fluid dispensing pump for use with fluids, or the like, comprising, in combination: a housing portion formed with an outlet port, said housing portion further containing a fluid chamber therein which communicates with said outlet port; conduit means communicating with said fluid chamber for conducting fluid from a reservoir to the fluid chamber; diaphragm means formed with an opening therethrough for controlling at predetermined pressures and flow characteristics the discharge of fluid through said outlet port, said opening being operatively disposed in a fluid path between said conduit means and said fluid chamber, said diaphragm means including a first valve portion integral therewith, said first valve portion initially obstructing said outlet port and being operably movable only in a substantially snap-like action between obstructing and non-obstructing positions; second valve means cooperative with and movable relative to said opening for controlling the flow of fluid therethrough; and actuating means for compressing the contents of said fluid chamber; said disphragm means comprising an upper rigid portion integral with said first valve portion, a lower rigid portion, and a relatively flexible portion connecting said upper and lower rigid portions and permitting said upper rigid portion to move in an over-center-type snap-like action with respect to said lower rigid portion and being responsive to the pressure within said fluid chamber and permitting the fluid to be discharged through said outlet port only upon said pressure reaching a minimum predetermined magnitude whereby substantially full atomization of the fluid dispensed is repeatedly realized, said flexible diaphragm means comprising a substantially frustro-conical shaped rigid material being flexible with substantially a snap action in response to minimum pressure forces thereon.

2. A pump according to claim 1, wherein said first valve portion comprises a wall member integral with said flexible diaphragm means and initially covering said outlet port.

3. A pump according to claim 1, wherein said second valve means comprises a movable checking member cooperative with sealing surfaces of said flexible diaphragm means disposed about said opening therethrough.

4. A pump according to claim 1, wherein said actuating means includes a button having internal piston means cooperative with walls defining said fluid chamber within said housing portion for creating increased pressures within said fluid chamber.

5. A pump according to claim 4, wherein said actuating means further comprises spring means for biasing said button toward its normal position and for restoring said button to this normal position once the latter has been depressed during a dispensing stroke.

* * * * *